US010506858B2

(12) United States Patent
Van Rooyen

(10) Patent No.: US 10,506,858 B2
(45) Date of Patent: Dec. 17, 2019

(54) SECURING AN OPENING OF A CARRYING CONTAINER

(71) Applicant: Veronica Van Rooyen, Toronto (CA)

(72) Inventor: Veronica Van Rooyen, Toronto (CA)

(73) Assignee: DIVA V., North York, Ontario (CA)

( * ) Notice: Subject to any disclaimer, the term of this patent is extended or adjusted under 35 U.S.C. 154(b) by 674 days.

(21) Appl. No.: 15/142,940

(22) Filed: Apr. 29, 2016

(65) Prior Publication Data

US 2016/0242520 A1 Aug. 25, 2016

Related U.S. Application Data

(63) Continuation-in-part of application No. 13/439,105, filed on Apr. 4, 2012, now abandoned.

(60) Provisional application No. 61/476,965, filed on Apr. 19, 2011.

(30) Foreign Application Priority Data

Nov. 18, 2011 (CN) ..... 2011 2 0471894 U

(51) Int. Cl.

| | |
|---|---|
| ***A45C 13/08*** | (2006.01) |
| ***A45C 13/10*** | (2006.01) |
| ***F21S 9/02*** | (2006.01) |
| ***F21S 10/06*** | (2006.01) |
| ***F21V 33/00*** | (2006.01) |
| ***F21V 23/04*** | (2006.01) |
| ***F21V 17/00*** | (2006.01) |

(52) U.S. Cl.

CPC ..... *A45C 13/08* (2013.01); *A45C 13/1069* (2013.01); *F21S 9/02* (2013.01); *F21S 10/06* (2013.01); *F21V 17/002* (2013.01); *F21V 23/0471* (2013.01); *F21V 33/0008* (2013.01); *F21V 33/0056* (2013.01)

(58) Field of Classification Search

CPC ..... A45C 13/08; A45C 13/10; A45C 13/1069; A45C 2013/1007; F21S 9/02; F21S 10/06; F21V 33/0008; F21V 33/0056; F21V 23/0471; F21V 17/002

USPC ..... 29/428, 525.01, 243.5, 446

See application file for complete search history.

(56) References Cited

U.S. PATENT DOCUMENTS

| | | | |
|---|---|---|---|
| 2,854,563 | A | 9/1958 | Catching |
| 4,076,976 | A | 2/1978 | Fenton |
| 4,096,552 | A | 6/1978 | Ben-Porat |

(Continued)

FOREIGN PATENT DOCUMENTS

| | | |
|---|---|---|
| CN | 201709572 | 1/2011 |
| DE | 29813164 | 2/1999 |

(Continued)

*Primary Examiner* — Peter Dungba Vo
*Assistant Examiner* — Kaying Kue
(74) *Attorney, Agent, or Firm* — Alfred M. Walker; Andrew F. Young

(57) ABSTRACT

A securing system for a container includes a securing system and an ornamental system selectively securable thereto for operably enabling a multitude of adaptive attractant features for greater expression of individuality. The securing system includes opposing elements effective to releasably secure opposing open side elements of the container against an unintended opening. The ornamental system includes an attractant feature and may optionally include additional attractant systems for presentation of a sound, a scent, a motion, or a secure access function.

18 Claims, 5 Drawing Sheets

(56) References Cited

U.S. PATENT DOCUMENTS

| | | | | |
|---|---|---|---|---|
| 4,261,121 | A | 4/1981 | Coon | |
| 4,559,583 | A | 12/1985 | Ku | |
| 4,912,608 | A | 3/1990 | Lee | |
| 4,975,809 | A | 12/1990 | Ku | |
| 5,143,439 | A | 9/1992 | Lewis | |
| 5,147,129 | A | 9/1992 | Ku | |
| 5,217,286 | A | 6/1993 | Ming-Ho | |
| 5,267,374 | A * | 12/1993 | Drake | B65D 33/1675 24/30.5 R |
| 5,622,062 | A * | 4/1997 | Gong-Hwa | A44C 15/0015 63/1.13 |
| 6,145,999 | A | 11/2000 | Van Derlande | |
| 6,176,356 | B1 * | 1/2001 | Powley | A45C 7/0095 190/1 |
| 6,273,245 | B1 | 8/2001 | Mickelson | |
| 6,393,668 | B1 | 5/2002 | Olson et al. | |
| 6,405,415 | B1 | 6/2002 | Meeks | |
| 6,659,617 | B1 | 12/2003 | Michael | |
| 6,925,689 | B2 | 8/2005 | Folkmar | |
| 7,264,515 | B1 | 9/2007 | Rubinstein | |
| 7,312,773 | B1 | 12/2007 | Herzen | |
| 7,360,926 | B2 | 4/2008 | Lee | |
| 7,557,705 | B2 * | 7/2009 | Oas | A45C 13/24 235/382 |
| D598,279 | S | 8/2009 | Seehoff et al. | |
| 2004/0103911 | A1 | 6/2004 | Salvero | |
| 2007/0193211 | A1 | 8/2007 | Harrison et al. | |
| 2007/0251268 | A1 | 11/2007 | Gisser et al. | |
| 2008/0088445 | A1 * | 4/2008 | Oas | A45C 13/24 340/571 |
| 2008/0304255 | A1 * | 12/2008 | Cauchois | F21S 9/02 362/183 |
| 2009/0032044 | A1 * | 2/2009 | Grimm | A45D 8/12 132/200 |
| 2009/0314677 | A1 * | 12/2009 | Teggatz | A45C 13/08 206/457 |
| 2014/0002239 | A1 * | 1/2014 | Rayner | G08B 13/1427 340/5.61 |
| 2014/0291405 | A1 * | 10/2014 | Harkes | G06K 19/0716 235/492 |

FOREIGN PATENT DOCUMENTS

| | | |
|---|---|---|
| DE | 29909288 | 9/1999 |
| DE | 29312063 | 11/2003 |
| JP | 2004316876 | 11/2004 |

* cited by examiner

SECURING AN OPENING OF A CARRYING CONTAINER

CROSS REFERENCE TO RELATED APPLICATIONS

This application is a continuation-in-part of application Ser. No. 13/439,105, filed Apr. 4, 2012. The '105 application relates to and claims priority from U.S. Provisional Ser. No. 61/476,965 filed Apr. 19, 2011, and Chinese Utility Model Ser. No. 201120471894.4 filed Nov. 18, 2011, the entire contents of each of which are incorporated herein by reference

FIGURE SELECTED FOR PUBLICATION

FIG. 1

BACKGROUND OF THE INVENTION

1. Field of the Invention

The present invention generally relates to an ornamental system for securing containers having an open portion. In particular, the invention relates to a system or kit for use with a container or tote container or bag and containing an ornamental/attractant securing unit for securing an open portion thereof and operably enabling a multitude of adaptive attractant features for greater expression of individuality.

2. Description of the Related Art

The term "tote" meaning "to carry" can be traced to the 17th century, but it was riot used to describe bags until early 20th century. Generally, a tote is a container of some kind that is configured to hold diverse day-to-day objects including, but not limited to books, umbrellas, and other recreational gear. The tote bag may also be used as a supporting volume for transporting food items, beverages arid other relatively small items typically piled upon one another in the tote. In other words, the tote bag is an everyday carrier for a variety of rather prosaic objects and items. Such tote bags may be provided as so-called gift bags, colored bags of paper formed for holding gifts or the like.

It is not uncommon to secure the access to the interior of a tote bag. A myriad of securing mechanisms for tote bags are disclosed in various publications. Perhaps one of the most known configurations has a clip which is not usually a decorative item and makes the entire tote bag look rather dull. Other securing mechanisms may be configured as, for example, magnets. Once again, inasmuch as Applicants are aware, none of magnet-based securing configuration may simultaneously function as a decorative element.

A need therefore exists for an aesthetically appealing but still functional tote bag configured with a securing mechanism.

Another need exists for a tote bag with a securing mechanism configured with a decorative component which serves to prevent immediate visual recognition of the securing mechanism.

A further need exists for a tote bag provided with a replaceable securing mechanism provided with a decorative component.

Still a further need exists for a kit including a plurality of structurally interchangeable but aesthetically different securing mechanisms for a tote bag.

Accordingly, there is a need for an improved ornamental securing mechanism for which optionally the parts may also be interchangeably modified to match a user's demand.

ASPECTS AND SUMMARY OF THE INVENTION

These and other needs are satisfied by a tote bag with a securing, mechanism configured in accordance with the present invention. One of runny salient features of the invention includes the securing mechanism removably mountable to the top lips of the tote bag so as to detachably and releasably seal the lips together. The securing mechanism is configured with a decorative component operative to shield the securing mechanism from being immediately recognized thus providing the tote bag with an attractant aesthetic appeal.

A securing system for a container includes a securing system and an ornamental system selectively securable thereto for operably enabling a multitude of adaptive attractant features for greater expression of individuality. The securing system includes opposing elements effective to releasably secure opposing open side elements of the container against an unintended opening. The ornamental system includes an attractant feature and may optionally include additional attractant systems for presentation of any one or a combination of a sound, a scent, a visual attractant indicia, a motion, or optionally a secure access function.

The inventive securing mechanism may be configured as a clip having two arms and a hinge unit resiliently biasing the arms toward one another. Still a further configuration of the securing mechanism includes differently polarized magnets removably or permanently attached to the top lips of the tote bag and securable to the ornamental element. Another configuration of the disclosed securing mechanism may be as simple as liners of Velcro@ removably attachable to the top lips of the disclosed tote bag, The inventive system will also be recognized to enable a collectability and a reusability of adaptively either the attractant member on other securing mechanisms, or collective use (attractant and securing mechanism) reusability and collectability. In this way, the system. can be retained between uses, sold as theme kits (e.g., holiday kits, celebration kits, birthday kits etc.) or similarly collected in that way and re-used as a user desires.

The above and other configurations of the disclosed securing mechanism and system each are provided with a decorative component or components which while providing a reliable element masking the securing mechanism are visually appealing. The other aspects, features and advantages of the present invention will become apparent from the following description read in conjunction with the accompanying drawings, in which like reference numerals designate the same elements,

BRIEF DESCRIPTION OF THE DRAWINGS

The invention may be better understood by reference to the detailed description of specific embodiments presented herein in combination with the following drawings, in which.

DETAILED DESCRIPTION OF THE PREFERRED EMBODIMENTS

Figure 1:
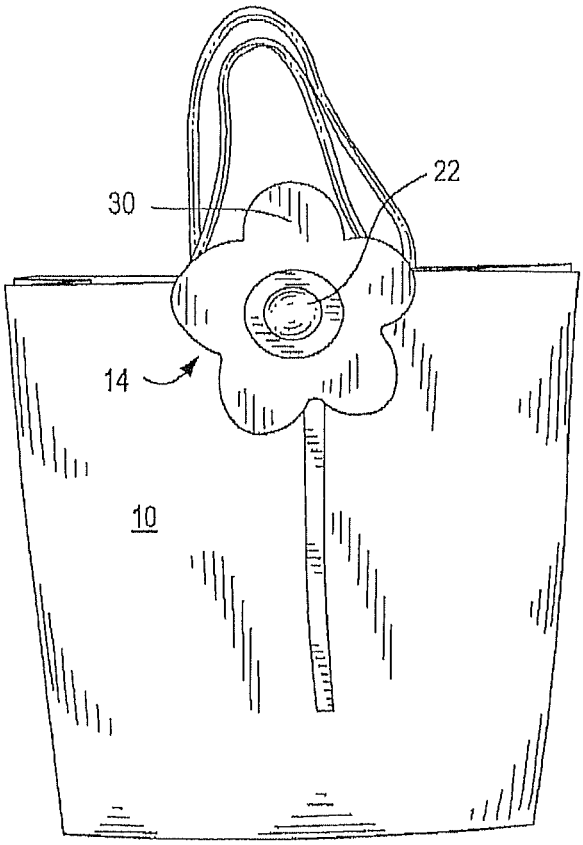
FIG. 1 is a front side elevational view of one of numerous alternative embodiments of the present invention, shown here on a representative disclosed tote bag.

Reference will now be made in detail to several embodiments of the invention that are illustrated in the accompanying drawings which are not to precise scale. Wherever possible, same or similar reference numerals are used in the drawings and the description to refer to the same or like parts or steps. The drawings are in simplified form, here representing exemplary photographed systems or kits, and are not to precise scale. For purposes of convenience and clarity only, directional terms, such as top, bottom, up, down, over, above, below, or near etc. may be used with respect to the drawings. These and similar directional or distant terms should not be construed to limit the scope of the invention in any manner. The words "connect," "couple," and similar terms with their inflectional morphemes do not necessarily denote direct and immediate connections, but also include connections through mediate elements or devices. It will be further recognized that elements discussed in the context of one alternative embodiment, may be adaptively and alternatively combined with ones of other alternative embodiments without departing from the scope or spirit of the present invention.

The present invention is an improved tote bag system that incorporates a decorative element or system configured in combination with and operative to mask the presence of a securing mechanism. The inventive tote bag allows for greater versatility, attractiveness, and finishing so that a single bag can serve a multitude of purposes and provide for greater expression of individuality.

FIG. 1 illustrates the inventive tote bag 10 provided with a securing mechanism which has a decorative or ornamental element or system or feature or means noted at 14 camouflaging the seeming mechanism so that the latter cannot be immediately observed from an outside or distant location and thereby prevents an immediate visual recognition of the securing mechanism.

In this alternative embodiment, tote bag 10 is configured with a pair of separate opposing flexible material front side sections, with the front side section being denoted at 12. The side sections are joined together about a perimeter but being separated along at least a portion of a top edge so as to define an opening between top lips 18, 18 providing the access into the interior of bag 10. Optionally, inventive tote bag 10 may be configured with a single piece of material folded so as to define the top arid rear side sections with an open top. A variety of non-limited materials can be used for configuring tote bag 10. For example, the material may include, without any limitation, a fabric, paper, plastic, neoprene, and/or the like. A myriad of configurations of the bag's exterior and interior, respectively, are contemplated within the scope of the invention. A handle 16 (shown here as flexible string or rope) is operably coupled to the respective top lips 18, 18 can also have a variety of configurations. For example, as illustrated, handle 16 includes two straps each coupled to side section 12.

At least front side section 12 of tote bag 10 is configured with an optionally removable decorative or ornamental component 14. Again, myriad differently configured decorative or ornamental components or elements 14 can be used within the scope of this invention, and those which are further disclosed represent only a small fraction of the alternative embodiments within the scope and spirit of the present invention. Therefore, this disclosure is not limited to the scope of the images. However, decorative component 14 is used here not only for ornamental, aesthetical, or attractant (e.g., advertizing) purposes. It is functionally configured to block or limit the view of a securing mechanism disclosed herein below.

In particular, decorative component 14, as illustrated in this exemplary embodiment, has a shape of flower with a stem extending along front side section 12 and may include any material such as a simple felt flower, gemstone cluster with an attached bow, surrounding puff ball, glittery light, projecting gift-card clip, sound generator, scent generator and etc. Portions of the felt flower 14 extend over top lips 18 to cover a securing mechanism 24, as will be discussed herein below. Optionally, the decorative component 14 may be permanently attached to tote bag 10, such as glued to front side section 12. Alternatively, decorative component 14 may be removably coupled to bag 10. Furthermore, as will be disclosed below, decorative component 14 may be optionally permanently or detachably coupled to securing mechanism 24. The detachable coupling (not shown) of decorative component 14 may have a variety of operative configurations such as snaps, rivets, spring-clip, adhesive, Velcro ° and the like for removably securing decorative element 14 to securing mechanism 24. For an additional alternative embodiment, the central region of decorative component 14 may be further enhanced with an additional ornamental attractant element 22 (FIG. 1) adding to the overall appeal of tote bag 10. The opposite side of element 22 may be formed as a snap removably coupled to front side section 12 of the rote or optionally may be secured to the front face of decorative element 14. While decorative component 14 is shown to be coupled to the front side section of securing mechanism 24, the scope of the invention includes a tote bag with two identical or differently configured decorative component coupled to respective fl-out and back side sections, and thus be ornamentally visible from opposing sides of tote 10.

Figure 2:
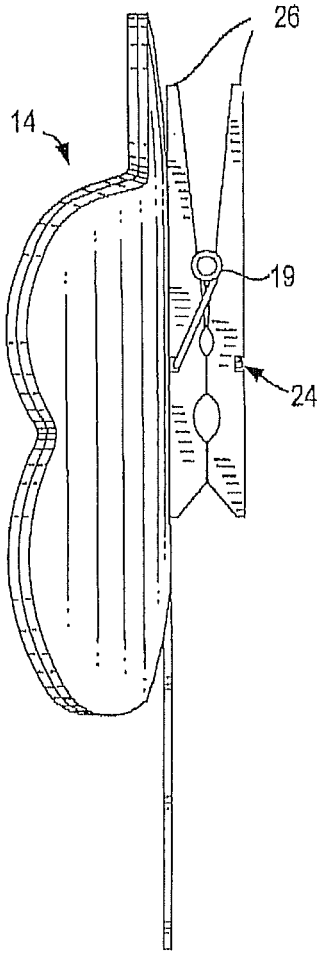
FIG. 2 is a close side devotional view of the exemplary configuration of the inventive system according to FIG. 1.

FIG. 2 illustrates one of several alternative operable configurations of securing mechanism 24 operative to close the bag opening and thus prevent an easy access into the interior of bag 10 as well as prevent items stored inside from incidentally falling out. As illustrated, seeming mechanism 24 is provided as a simple spring clip or spring member provided with two opposing arms or wings 26, 26 and a hinge means 19 which is configured to bias for example bottom portions of respective arms 26, 26 towards one another. The clip itself may be configured as a binder clip, clothes pin, and spring clip. A different concept of the securing mechanism configuration relates to a magnetic securing mechanism. The latter may be configured with a magnetic member and a metal or second magnetic member joined by a flexible line or tab-hinge member, thereby operably functioning as a 'magnetic clip system. Further alternatively, securing mechanism may be provided with two opposing and non-linked magnetically attractant members (one or both a magnet, and optionally a ferrous material e.g., metal), whereby the decorative element is secured to one of the securing mechanisms and the lips of tote 10 are urged together solely by opposing magnetic coupling urges. Regardless of the design of securing mechanism 24, aesthetic and even security reasons often require adaptively camouflaging the mechanism.

In accordance with the invention, decorative component 14 is configured to be at optimally at least ½ greater than, and desirably larger than securing mechanism 24 so as to prevent immediate visual recognition of the latter. In particular, the present exemplary embodiment provides decorative component 14 having a protrusion 30 extending not only above the top lips of bag 10, but this part also extends over the top ends of the clip. Obviously, the clip is not visible or at least not immediately recognized by someone looking at the front section of bag 10.

Figure 3:
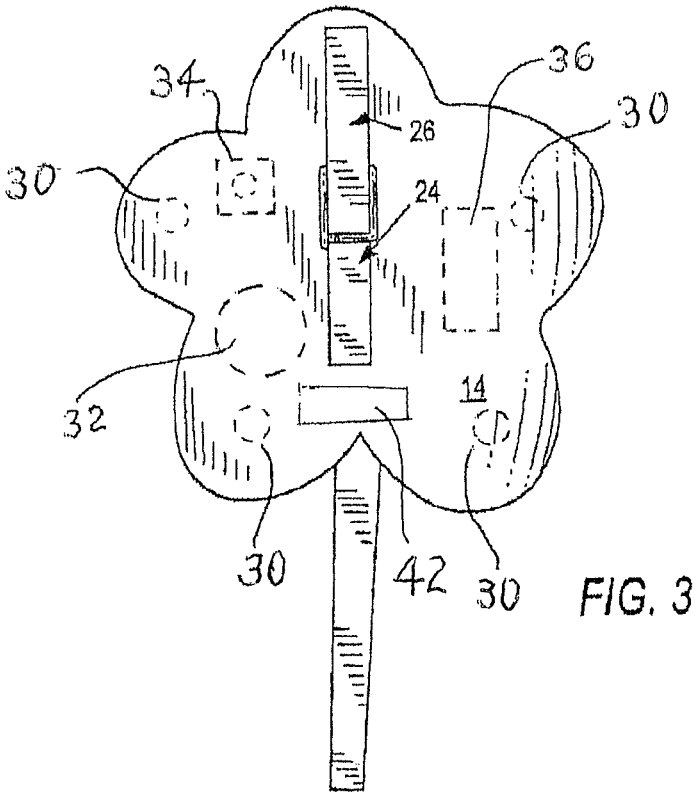
FIG. 3 is a rear side devotional view of the seeming mechanism of FIG. 2 without the disclosed tote bag.
Figure 4:
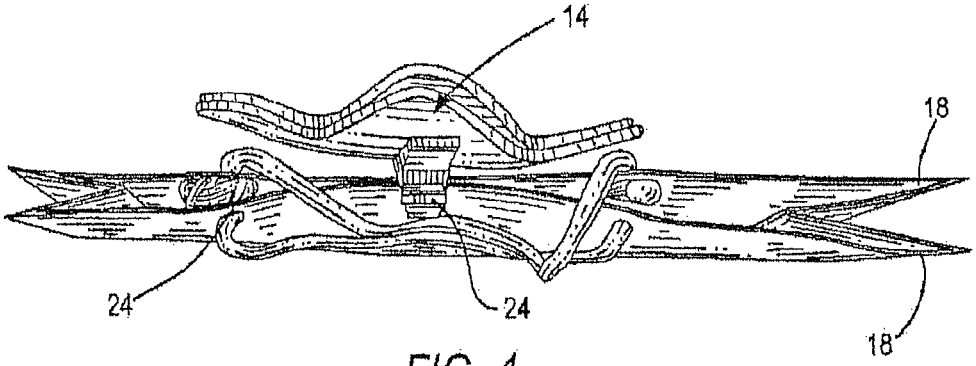
FIG. 4 is a top plan view of the inventive embodiment of FIG. 1, wherein the securing system operably wad releasably secures sides of the tote bag.
Figure 5:
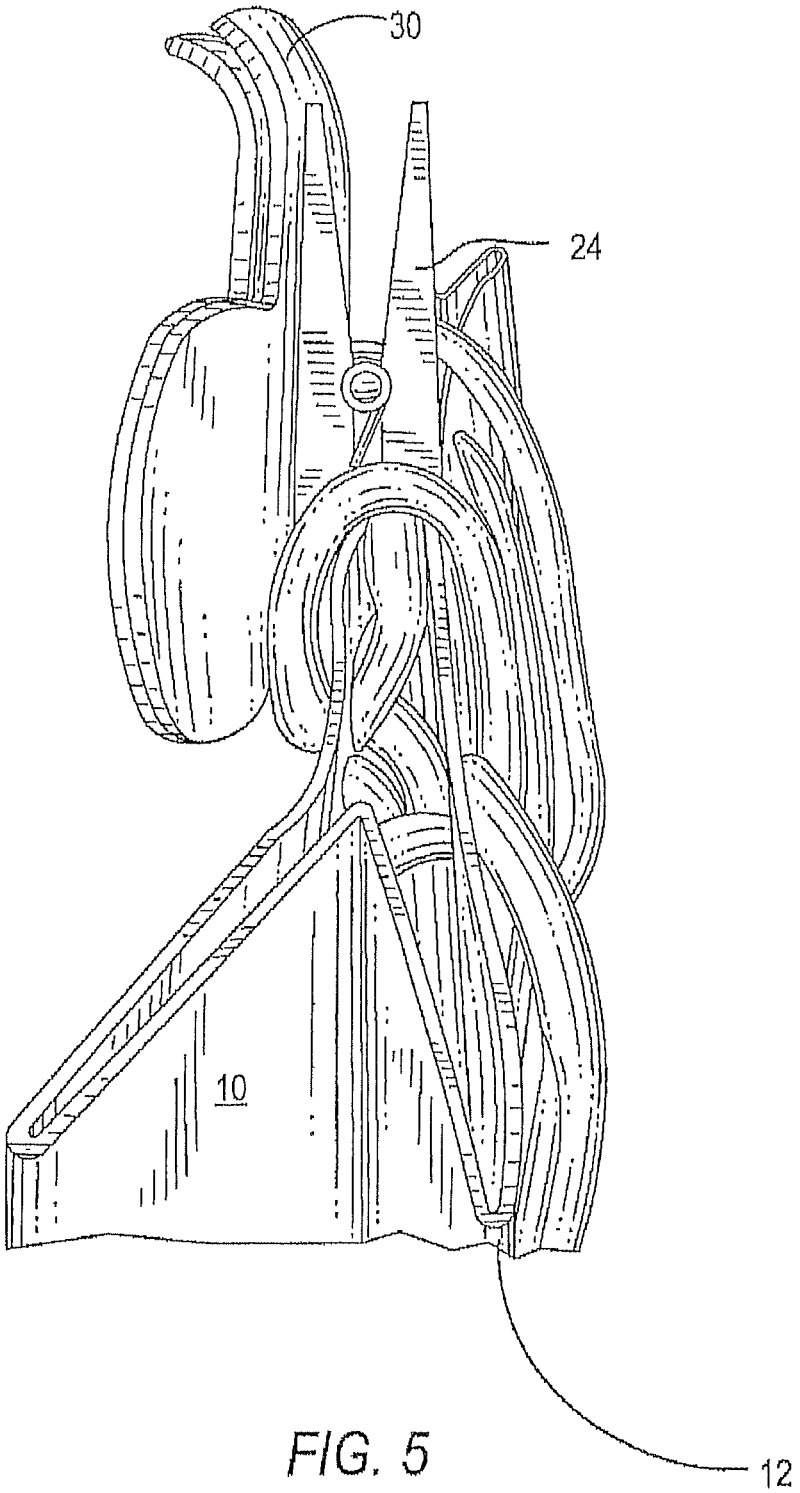
FIG. 5 is a close side elevational view of FIG. 4 wherein the securing system and the ornamental features are shown in close association with the opening of the tote bag.

Referring further to FIGS. 3-5, alternative views of a similar coupling means (shown as a spring clip 19 in FIG. 2) between the securing mechanism and decorative component are contemplated within the scope of the invention. For example, decorative component 14 and securing mechanism 24 may be fixed to one another by a fastening means including, for example, but not limited to glue. Alternatively, the fastening means may be configured as a snap, sliding engagement etc. In accordance with the latter, differently shaped and sized decorative components 14 may be easily used in combination with the same securing mechanism. Alternatively, decorative component 14 may be detachably coupled to securing mechanism 24.

Speaking of different configurations, the scope of the invention includes a kit provided with differently shaped and dimensioned decorative components and securing mechanisms. The kit allows the user to select different combinations of the securing and decorative components.

Figure 6:
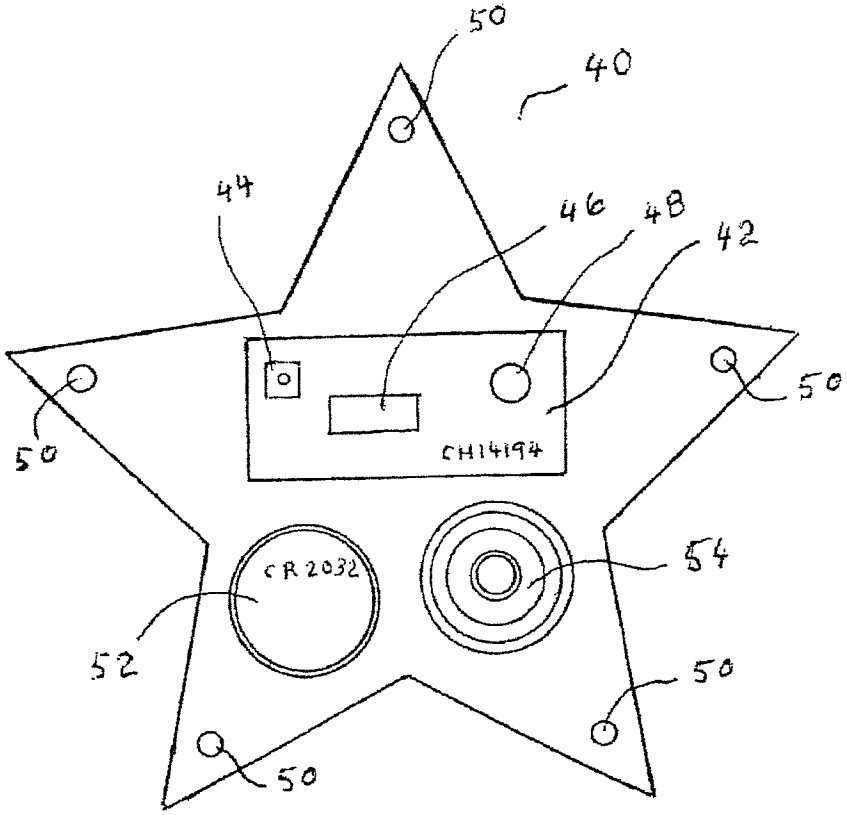
FIG. 6 is a rear elevation of a star shaped decorative item with the rear clip cover removed showing details of a visual and sound attractant system based on the use of a small electronics board usually incorporated into high-end greeting cards.

Returning to the decorative component, in particular FIG. 3, the configuration of the latter may include any shape and size, provided the design is within the scope and spirit of the present invention. For example, decorative mechanism may include a means for generating light containing a light emitter 30, a power supply (battery) 32 and a switch 34 or operating mechanism of a kind known to those of skill in the art. The light emitter may have one or a plurality of LEDs. It is contemplated that the light mechanism is energized by a local battery which in turn can be triggered by a switch, by motion sensor 36 etc. It is further contemplated that there may be alternative flashing sequences, or colors, as a form of attraction. An example of a decorative mechanism including a means for generating light containing a light emitter, a power supply (battery) and a switch or operating mechanism is shown in FIG. 6. Mounted to the back of decorative item 40 are five LED's 50, a loudspeaker 54, a lithium coin cell battery power supply 52, and a commercially available electronics board 42 with processor module 46, flash memory chip 48 for sound content, and momentary switch 44 with modes to select LED "chasing" display, all LED's flashing rapidly, or playing music or sounds from loudspeaker. In a further modification, the inventive decorative component may adaptively and operatively include a sound and/or a motion generating unit 42. Again, distantly triggered or locally triggered, the sound and/or motion generating unit 42 may reproduce musical pieces, voices, easily recognizable sounds, or may cause a motion-mechanism (e.g., a dancing-seasonal figure (Santa, Valentine Heart) to move through a repeated sequence. The unit 42 may even be configured to allow the user to record a personal audio message for reply by a second user.

Figure 7:
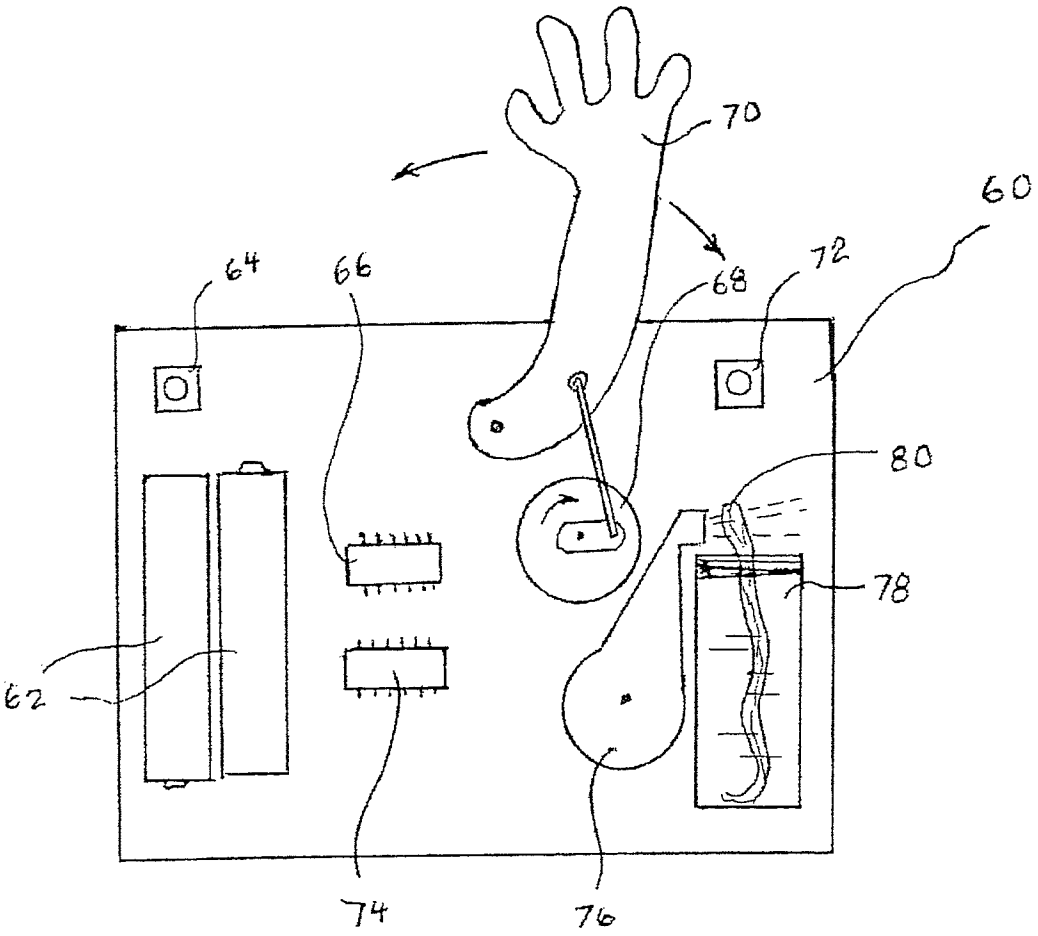
FIG. 7 is a rear elevation of a custom circuit board to be mounted to the back of a decorative item on which are mounted all electronic and mechanical components implementing motion and scent attractants.

A second example is shown in FIG. 7. Here on a custom board 60 are mounted components implementing two further attractants. Two alkaline cells 62 provide power. Switch 64 selects motor driver and timer 66 which operates gear motor 68 for short duration bursts with stationary intervals thereby moving motion attractant 70 back and forth through a crank mechanism (waving motion). Switch 72 selects motor driver/timer/motion detector which operates blower 76 motor. When close motion is detected, blower 76 is operated for a short duration wafting scent from the end of wick 80 which penetrates the cap of scent fluid reservoir 78. The electronics on-board are similar to that on Pololu Oik 2s9v1 dual motor controller board sold to robotics hobby enthusiasts.

The inventive decorative component may also alternatively be provided with a combination of pockets differently designed and dimensioned to receive adaptive or supplemental items (in addition to the contents of the tote). The pockets may contain fortunes, sayings, messages, novelty and gift items, candies. Some sort of additional 'treat' or 'teaser' is also contemplated within the scope of the invention. In addition, the inventive decorative component may include a timer coupled to a recorder informing the user that an appropriate and previously stored time for revealing the gift has come. At that point, user may open a pocket or tote, or optionally the mechanism may even automatically open to allow the user to pull out the gift (e.g., an audio recording of ". . . wait until I get home to open the gift . . . ").

Still a further configuration may include a scent-releasable mechanism. Scents may be released in different manners such as by mistering, scratching, or a mechanism containing a solid or gel scent+a warming/releasing mechanism etc. The mechanism may be configured as a flat element, multi-dimensional element, a blower fan may be incorporated etc. within the meaning and scope of the present invention to attract a user.

The present invention is not restricted to the particular configurations described and illustrated. The described embodiments are not exclusive, and the scope of the invention includes farther different configurations and structures. It is apparent that departures from specific structures and configurations described and shown will suggest themselves to those skilled in the related art and may be used without departing from the spirit and scope of the present invention. Accordingly, the invention should be construed to cohere with all modifications that may fall within the scope of the following brief description of the inventive main features.

Brief Description of Main Features of the Invention

A hand-held bag comprises a body defining an interior and provided with an access to the interior, a securing mechanism operative to temporarily restrict or prevent the access to the interior, and a decorative component configured to prevent immediate recognition of the securing mechanism. it will be recognized that the decorative component can be of any attractant type, including, without limitation a textile, printed, film, plush vehicle, or three-dimensional object. For example, as in Fig. I, a combined attractant includes a textile item and a formed three-dimensional jewel object. Alternatively, a small plush character or fuzzy item or rigid three-dimensional sculptural item may be employed. Organic items (e.g., flowers) may also be provided and are within the scope and spirit of the present invention, A hand-held bag comprises a body defining an interior and provided an access to the interior, a securing mechanism operative to temporarily restrict or prevent the access to the interior, and a decorative component configured to prevent immediate recognition of the scouring mechanism, the securing mechanism comprises a clip selected from the group consisting of a binder clip, clothes pin, spring clip paper, and others, A hand-held bag comprises a body defining an interior and provided with an access to the interior, a securing mechanism operative to temporarily restrict or prevent the access to the interior, and a decorative component configured to prevent immediate recognition of the securing mechanism, the securing mechanism comprises a magnetic clip including a combination of one magnetic and one metal components or two magnetic components, A hand-held bag comprises a body defining an interior and provided with an access to the interior, a securing mechanism operative to temporarily restrict or prevent the access to the interior, and a decorative component configured to prevent immediate recognition of the securing mechanism, the securing mechanism comprises a magnetic clip including a combination of one magnetic and one metal components or two magnetic components/

A hand-held bag comprises a body defining an interior and provided with an access to the interior, a securing mechanism operative to temporarily restrict or prevent the access to the interior, and a decorative component configured to prevent immediate recognition of the securing mechanism, the decorative component is either fixed to the body or detachably coupled thereto.

A hand-held bag comprises a body defining an interior and provided with an access to the interior, a securing mechanism operative to temporarily restrict or prevent the access to the interior, and a decorative component configured to prevent immediate recognition of the securing mechanism, the securing mechanism is either fixed to the body or detachably coupled thereto.

A hand-held bag comprises a body defining an interior and provided with an access to the interior, a securing mechanism operative to temporarily restrict or prevent the access to the interior, and a decorative component configured to prevent immediate recognition of the securing mechanism, the decorative component and locking mechanism are either fixed to one another or detachably coupled to one another.

A hand-held bag comprises a body defining an interior and provides an access to the interior, a securing mechanism operative to temporarily restrict or prevent the access to the interior, and a decorative component configured to prevent immediate recognition of the securing mechanism, the decorative component has a plurality of configurations and is selected from the group comprising one of decorative ornaments made from plastic, fabric or paper, metal, wood and/or or a combination thereof.

A hand-held bag comprises a body defining an interior and provided with an access to the interior, a securing mechanism operative to temporarily restrict or prevent the access to the interior, and a decorative component configured to prevent immediate recognition of the securing mechanism, the decorative component has a plurality of configurations and is selected from the group comprising a sound unit, motion unit, sound generating, light emitting, scent-emitting unit and/or a combination of these.

A hand-held bag comprises a body defining an interior and provided with an access to the interior, a securing mechanism operative to temporarily restrict or prevent the access to the interior, and a decorative component configured to prevent immediate recognition of the securing mechanism, the decorative component has a plurality of configurations and selected from the group comprising an arrangement of differently shaped and dimensioned pockets, each pocket may comprise a gift, teaser etc.

A kit for a hand-held bag comprises one or more securing mechanisms each operative to temporarily restrict or prevent the access to an interior of the hand-held bag, and one or a plurality of decorative components, the securing mechanisms and decorative components are configured are selectively coupleable to one another so that the decorative component prevents immediate recognition of the securing mechanism.

What is claimed is:

1. A method for securing an opening into a carrying container, wherein said method comprises the steps of:

providing a system for securing said opening into said container;

providing a decorative ornament attachable to said securing system, said decorative ornament including a protrusion configured so as to substantially hide said securing system from view, and an attractant element removably secured to said decorative ornament, said decorative ornament further including an attachment member for removable attachment to said securing system, and providing said securing system with a securing mechanism for operably and removably securing opposing container sides of an external container during a use thereof;

attaching said decorative ornament to said securing system in a removably secured arrangement to a portion of said container during said use; and providing said attractant element with a light emitter, a power supply, and a motion sensor for generating light upon being triggered.

which said attractant element further includes at least one of a sound and a motion generating unit for reproducing at least one of musical pieces, voices, recognizable sounds, or to cause a motion mechanism to move through repeated sequences.

2. The method according to claim 1, wherein said securing mechanism for operably and removably securing includes a first closing member, a second closing member, and at least one of a spring clip and a magnet for releasably urging said first closing member toward said second closing member.

3. The method according to claim 1, wherein said attractant element removably secured to said decorative ornament is selected from the group consisting of a light attractant, a motion attractant, an audio attractant, a scent attractant, and a combination of said attractants, each of said attractants being powered by a power generator.

4. The method according to claim 3 wherein said attractant element includes a scent-releasing mechanism.

5. The method according to claim 1, wherein said decorative ornament comprises a floral image, said protrusion being a portion of said floral image and said decorative ornament includes an audio attractant.

6. The method according to claim 1, further comprising the step of removably securing at least two attractants to said decorative ornament.

7. The method according to claim 6, further comprising the step of removably securing a light attractant and a scent attractant from said at least two attractants to said decorative ornament.

8. The method according to claim 6, further comprising the step of removably securing a light attractant, an audio attractant and a motion attractant from said at least two attractants to said decorative ornament.

9. The method according to claim 1 further comprising a custom board having mounted components implementing at least two further attractants, whereby a switch selects a motor driver and timer which operates a motor for short duration bursts with stationary intervals, thereby moving said motion attractant back and forth through a crank mechanism causing a waving motion.

10. The method according to claim 9 further comprising a motor driver, a timer, and a motion detector operating a blower motor, whereby when close motion is detected, said blower is operated for a short duration, wafting scent from an end of a scent-emitting wick which penetrates a cap of a scent fluid reservoir.

11. The method according to claim 1 further comprising at least one of a triggerable sound and a motion generating unit reproducing at least one of musical pieces, voices, recognizable sounds, and causing a motion-mechanism of a perceptible object moving through a repeated sequence.

12. The method according to claim 11 further comprising a user operable recorder configured to allow the user to record a personal audio message for reply by a second user .

13. A method for securing an opening into a carrying container, wherein said method comprises the steps of:

providing a system for securing said opening into said container;

providing a decorative ornament attachable to said securing system, said decorative ornament including a protrusion configured so as to substantially hide said securing system from view, and an attractant element removably secured to said decorative ornament, said decorative ornament further including an attachment member for removable attachment to said securing system, and providing said securing system with a securing mechanism for operably and removably securing opposing container sides of an external container during a use thereof;

attaching said decorative ornament to said securing system in a removably secured arrangement to a portion of said container during said use; and providing said attractant element with a light emitter, a power supply, and a motion sensor for generating light upon being triggered;

wherein said light emitter comprises a switch and a plurality of LED lights and an electronics board with a processor module, a flash memory chip for sound content, and a momentary switch with modes to select an LED chasing display, whereby said LED lights flash rapidly, said sound content including playing music or sounds from a loudspeaker.

14. The method according to claim 13 further comprising at least one of a triggerable sound and a motion generating unit reproducing at least one of musical pieces, voices, recognizable sounds, and causing a motion-mechanism of a perceptible object moving through a repeated sequence.

15. The method according to claim 14 further comprising a user operable recorder configured to allow the user to record a personal audio message for reply by a second user.

16. The method according to claim 13 further comprising a custom board having mounted components implementing at least two further attractants, whereby a switch selects a motor driver and timer which operates a motor for short duration bursts with stationary intervals, thereby moving said motion attractant back and forth through a crank mechanism causing a waving motion.

17. The method according to claim 16 further comprising a motor driver, a timer, and a motion detector operating a blower motor, whereby when close motion is detected, said blower is operated for a short duration, wafting scent from an end of a scent-emitting wick which penetrates a cap of a scent fluid reservoir.

18. The method according to claim 13, wherein said attractant element removably secured to said decorative ornament is selected from the group consisting of a light attractant, a motion attractant, an audio attractant, a scent attractant, and a combination of said attractants, each of said attractants being powered by a power generator.

* * * * *